United States Patent [19]

Perrig

[11] 4,408,997

[45] Oct. 11, 1983

[54] PROCESS FOR DYEING COTTON WITH REACTIVE DYES IN WEAKLY ALKALINE DYE-BATH(PH 8.0–8.8)

[75] Inventor: Max Perrig, Arlesheim, Switzerland

[73] Assignee: Sandoz Ltd., Basel, Switzerland

[21] Appl. No.: 316,704

[22] Filed: Oct. 28, 1981

[30] Foreign Application Priority Data

Oct. 30, 1980 [DE] Fed. Rep. of Germany ..... 3040832
Oct. 30, 1980 [DE] Fed. Rep. of Germany ..... 3040833

[51] Int. Cl.[3] ..... D06P 1/67; D06P 3/66

[52] U.S. Cl. ..... 8/532; 8/549; 8/618; 8/918

[58] Field of Search ..... 8/532, 549, 618

[56] References Cited

U.S. PATENT DOCUMENTS

| | | | |
|---|---|---|---|
| 3,497,309 | 2/1970 | Seltzer | 8/549 |
| 3,617,168 | 11/1971 | Mack | 8/532 |
| 3,617,169 | 11/1971 | Schulz | 8/532 |
| 3,767,356 | 10/1973 | Turner | 8/532 |
| 3,807,945 | 4/1974 | von der Eltz | 8/532 |
| 4,264,321 | 4/1981 | von der Eltz | 8/532 |
| 4,277,246 | 7/1981 | Lehinant et al. | 8/532 |
| 4,283,193 | 8/1981 | Hildebrand | 8/400 |

FOREIGN PATENT DOCUMENTS

| | | |
|---|---|---|
| 36537 | 9/1981 | European Pat. Off. . |
| 17172 | 8/1982 | European Pat. Off. . |
| 2913718 | 10/1980 | Fed. Rep. of Germany . |
| 503155 | 3/1971 | Switzerland . |

OTHER PUBLICATIONS

K. H. Hoppen, Dyers Digest, Jan. 1981, pp. 3, 4, 7 and 9.

*Primary Examiner*—A. Lionel Clingman
*Attorney, Agent, or Firm*—Gerald D. Sharkin; Richard E. Vila; Thomas C. Doyle

[57] ABSTRACT

Cellulosic fabrics may be dyed by cold-dyeing reactive dyes under weakly alkaline conditions (0.2–1 g/l soda) at 60°–80° C. in the presence of moderate amounts of salt. This is advantageously used for the dyeing of mixed cotton/polyester substrates in a one-bath process with a mixture of reactive and disperse dyes.

19 Claims, No Drawings

PROCESS FOR DYEING COTTON WITH REACTIVE DYES IN WEAKLY ALKALINE DYE-BATH(PH 8.0-8.8)

The invention relates to a process for dyeing with reactive dyes, alone or in admixture with disperse dyes.

Cellulosic fabrics such as cotton are normally dyed with reactive dyes under strongly alkaline conditions. If weakly alkaline or neutral conditions are used, as for example is necessary when dyeing mixed cotton/-polyester fabrics in a one-bath process with a mixture of reactive and alkali-sensitive disperse dyes, then the fixation yield of the reactive dye on the cotton fibres is greatly reduced, and large quantities of salt (e.g. 100-200 g/l) must be used in order to obtain an acceptable yield. With many dyeing machines it is very difficult to work with such high salt concentrations.

It has now been found that cold-dyeing reactive dyes may be dyed on cotton under weakly alkaline conditions in a dyebath containing 0.2 to 1 g/l of calcined soda (sodium carbonate), at 60°-80° C. Only moderate quantities of salt are required, such as can be used without difficulty in modern piece- and circulation dyeing machines.

Accordingly, the present invention provides a process for the dyeing of substrates comprising or consisting of cotton fibres with a reactive dye having a fluorochloropyrimidine, monofluorotriazine, dichlorotriazine, dichloroquinoxaline or methylsulphochloromethylpyrimidine reactive group at a temperature of 60°-80° C. in a dyebath containing 0.2 to 1 g/l soda and 20-60 g/l salt.

The weight of soda is calculated on the basis of calcined soda, and would be correspondingly higher if hydrated sodium carbonate were used. By 'salt' is meant any neutral salt commonly used in reactive dyeing processes to increase yield, preferably Glauber's salt (sodium sulphate) or common salt (sodium chloride). Preferably 0.4-0.6 g/l soda and 40-60 g/l salt is used. The preferred salt is sodium chloride.

The pH of the dyebath during dyeing with the reactive dye depends upon the exact quantities of soda and of salt used, and is normally in the range 8.0 to 9.8, preferably 8.0-8.8, more preferably 8.0 to 8.5.

Dyeing of cotton fibres with reactive dyes under these conditions allows a one-bath dyeing process for mixed cotton/polyester goods with a mixture of reactive and disperse dyes. After the reactive dye has been substantially fixed according to the process of the invention, the disperse dye is fixed either by raising the temperature to 130° C. under pressure, or by boiling in the presence of a disperse dye carrier. As many disperse dyes are unstable even to weak alkali at high temperatures, it is preferred to adjust the pH of the dyebath to pH 4.5-6 before raising the temperature.

According to a further aspect of the invention, therefore, there is provided a one-bath process for the dyeing of a substrate comprising a mixture of cotton and polyester fibres with a mixture of a reactive dye having a fluorochloropyrimidine, monofluorotriazine, dichlorotriazine, dichloroquinoxaline or methylsulphochloromethylpyrimidine reactive group and a disperse dye stable at pH 8 and 130° C., characterised in that the dyebath contains, in addition to the dyestuffs, 0.2 to 1 g/l soda and 20-60 g/l salt, and that the dyebath is held at 60°-80° C. until the reactive dyestuff is substantially fixed and then either heated to 110°-130° C. or heated in the presence of a disperse dye carrier to 98°-104° C. until the disperse dyestuff is substantially fixed.

In this embodiment of the invention, the exact quantity of soda used, and therefore the pH of the dyebath, will be adjusted to take into account the alkali stability of the disperse dye employed. Thus a dyebath pH of 9.0, for example, would be used only if the disperse dye was stable at pH 9 at the temperature of the dyeing process.

Preferably the dyebath is held for 10-20 minutes at 60°-80° C., and for 10-60 minutes at 110°-130° C. or, in the presence of a carrier, for 30-60 minutes at 98°-104° C. The heating from the initial temperature of 20°-40° C. to 60°-80° C. preferably takes 10-60 minutes as does the second heating stage to 110°-130° C. or to 98°-104° C. Preferably the salt content is from 30-60 g/l, more preferably 40-60 g/l, and the preferred salt is sodium chloride. Preferably the dyebath contains 0.4 to 0.6 g/l soda.

The dyebath may also contain conventional additives, for example dispersing agents, lubricants etc. in the usual amounts. When a carrier is present this may be any conventional carrier in normally used quantities. The presence of meta-nitrobenzenesulphonic acid sodium salt is also advantageous in order to prevent reduction of the reactive dye.

Disperse dyestuffs which are stable to pH 8 at temperatures up to 130° C. are known to the dyestuff chemist, and include for example C.I. Disperse Yellow 23 and 50; C.I. Disperse Orange 96; C.I. Disperse Red 43, 121 and 210, C.I. Disperse Blue 183 and similar compounds.

According to a preferred aspect of the invention, there is provided a one-bath process for the dyeing of a substrate comprising a mixture of cotton and polyester fibres with a mixture of a reactive dye having a fluorochloropyrimidine, monofluorotriazine, dichlorotriazine, dichloroquinoxaline or methylsulphochloromethylpyrimidine reactive group and a disperse dye, characterised in that the dyebath contains, in addition to the dyestuffs, 0.2-1 g/l soda and 20-60 g/l salt, and that the dyebath is held at 60°-80° C. until the reactive dyestuff is substantially fixed and then the dyebath is adjusted to pH 4.5-6 and either heated to 110°-130° C. or heated in the presence of a disperse dye carrier to 98°-104° C. until the disperse dyestuff is substantially fixed.

The pH may be adjusted by addition of a mineral acid, for example sulphuric acid, but preferably an organic acid, particularly formic or acetic acid, is used.

The preferred heating times, salt and soda contents are the same as given above for the process in which the pH is not adjusted. The same conventional additives, including the carrier and meta-nitrobenzenesulphonic acid sodium salt may be used.

In this embodiment of the process according to the invention it is not necessary to select alkali-stable disperse dyes, and any conventional disperse dyes may be used.

For use in the process of the invention the preferred reactive dyes are those having a fluorochloropyrimidine reactive group, for example C.I. Reactive Yellow 25, 64, 111 and 125; C.I. Reactive Orange 69; C.I. Reactive Red 123, 147, 159 and 171; C.I. Reactive Blue 113, 114, 116, 120, 170 and 178; C.I. Reactive Violet 23 and 33 and C.I. Reactive Green 21.

The following Examples, in which all parts are by weight and all temperatures are in degrees Centigrade, illustrate the invention:

EXAMPLE 1

To a dyebath containing 1000 parts water at 30° was added 100 parts of a cotton/polyester (55/45) fabric, then the following components were added:

1 part conventional non-ionic dispersing agent
50 parts sodium chloride
0.5 parts calcined soda
2.5 parts C.I. Reactive Blue 178
0.85 parts C.I. Disperse Blue 183

The bath was stirred 10 minutes at 30° then heated over 50 minutes to 80°, held at 80° for 10 minutes then heated over 60 minutes to 130° and held at 130° for 30 minutes. After soaping and rinsing an even deep blue dyeing was obtained.

EXAMPLE 2

To a dyebath containing 1000 parts water at 30° was added 100 parts of a cotton/polyester (65/35) fabric. The following components were added in the stated order:

2 parts sodium metanitrobenzenesulphonate
2 parts conventional non-ionic dispersing agent
1 part conventional fabric lubricant
40 parts sodium chloride
0.5 parts calcined soda
0.4 parts C.I. Reactive Red 147
1.4 parts C.I. Reactive Violet 33
0.1 part C.I. Disperse Red 53
0.6 part C.I. Disperse Violet 27
0.03 part C.I. Disperse Blue 58.

The bath was stirred 15 minutes at 30° then heated over 45 minutes to 80° and held at this temperature for 15 minutes. The pH of the bath was adjusted to pH 5 with formic acid and 4 parts of a commercial disperse dye carrier were added. The temperature was raised to 104° (boil) over 30 minutes and dyeing was carried out at the boil for 45 minutes. After soaping and rinsing a brilliant red-violet dyeing was obtained.

EXAMPLE 3

The dyebath contained the same fabric and additives as in Example 2, but with the following dyestuffs replacing those of Example 2:

1.2 parts C.I. Reactive Blue 114
0.1 part C.I. Reactive Blue 116
0.7 part C.I. Disperse Blue 58
0.02 part C.I. Disperse Blue 183.

The bath was stirred 15 minutes at 30° then heated over 40 minutes to 80° and held at 80° for 15 minutes. The pH of the bath was adjusted to pH 5 with formic acid, and the bath was then heated to 130° over 60 minutes and held at this temperature for 30 minutes. After soaping and rinsing a brilliant blue dyeing was obtained.

What is claimed is:

1. A process for dyeing a substrate comprising or consisting of cotton fibers which comprises treating the substrate at a temperature of 60° to 80° C. in a dyebath having a pH of 8.0 to 8.8 and containing a reactive dye having a fluorochloropyrimidine, monofluorotriazine, dichlorotriazine, dichloroquinoxaline or methylsulphochloromethylpyrimidine reactive group, 20 to 60 g/l salt and, as the sole alkaline agent, 0.2 to 1 g/l calcined sodium carbonate or the equivalent amount of hydrated sodium carbonate, the total amount of the reactive dye to be applied to the substrate being present in the dyebath at the commencement of the treatment of the substrate in the dyebath at 60° to 80° C.

2. A process according to claim 1 wherein the dyebath contains 40 to 60 g/l salt.

3. A process according to claim 1 wherein the salt is sodium sulphate or sodium chloride.

4. A process according to claim 2 in which the dyebath contains 40–60 g/l sodium chloride.

5. A process according to claim 1 wherein the dyebath contains 0.4 to 0.6 g/l calcined sodium carbonate or an equivalent amount of hydrated sodium carbonate.

6. A process according to claim 1 wherein the pH of the dyebath is in the range 8.0 to 8.5.

7. A process according to claim 1 wherein the reactive dye has a fluorochloropyrimidine reactive group.

8. A process according to claim 5 wherein the dyebath contains 40 to 60 g/l sodium sulphate or sodium chloride.

9. A process according to claim 1 wherein the substrate comprises a mixture of cotton and polyester fibers and the dyebath further contains a disperse dye which is stable at pH 8 and 130° C., which process comprises treating the substrate in the dyebath at 60° to 80° C. until the reactive dye is substantially fixed thereon and then heating the dyebath containing the substrate to 110° to 130° C. until the disperse dye is substantially fixed on the substrate.

10. A process according to claim 1 wherein the substrate comprises a mixture of cotton and polyester fibers and the dyebath further contains a disperse dye which is stable at pH 8 and 130° C., which process comprises treating the substrate in the dyebath at 60° to 80° C. until the reactive dye is substantially fixed thereon and then heating the dyebath containing the substrate and a carrier for the disperse dye to 98° to 104° C. until the disperse dye is substantially fixed on the substrate.

11. A process according to claim 1 wherein the substrate comprises a mixture of cotton and polyester fibers and the dyebath further contains a disperse dye, which process comprises treating the substrate in the dyebath at 60° to 80° C. until the reactive dye is substantially fixed thereon and then adjusting the pH of the dyebath to 4.5 to 6 and heating the dyebath containing the substrate to 110° to 130° C. until the disperse dye is substantially fixed on the substrate.

12. A process according to claim 1 wherein the substrate comprises a mixture of cotton and polyester fibers and the dyebath further contains a disperse dye, which process comprises treating the substrate in the dyebath at 60° to 80° C. until the reactive dye is substantially fixed thereon and then adjusting the pH of the dyebath to 4.5 to 6 and heating the dyebath containing the substrate and a carrier for the disperse dye to 98° to 104° C. until the disperse dye is substantially fixed on the substrate.

13. A process according to claim 11 or 12 in which the pH is adjusted by the addition of formic or acetic acid.

14. A process according to claims 9, 10, 11 or 12 wherein the dyebath contains meta-nitrobenzenesulphonic acid in an amount effective to prevent reduction of the reactive dye.

15. A process according to claims 9, 10, 11 or 12 wherein the pH of the dyebath during dyeing with the reactive dye is in the range 8.0 to 8.5.

16. A process according to claims 9, 10, 11 or 12 wherein the dyebath contains 40 to 60 g/l salt.

17. A process according to claims 9, 10, 11 or 12 wherein the salt is sodium chloride or sodium sulphate.

18. A process according to claims 9, 10, 11 or 12 wherein the dyebath contains 0.4 to 0.6 g/l calcined sodium carbonate or an equivalent amount of hydrated sodium carbonate.

19. A process according to claim 18 wherein the deybath contains 40 to 60 g/l salt.

* * * * *